US005639047A

United States Patent [19]

Boget et al.

[11] Patent Number: 5,639,047

[45] Date of Patent: Jun. 17, 1997

[54] RAILROAD SIGNAL WITH REMOTE LIGHT SOURCE

[75] Inventors: Paul J. Boget, Murrysville; James P. Chew, Jeannette, both of Pa.

[73] Assignee: Union Switch & Signal, Inc., Pittsburgh, Pa.

Related U.S. Application Data

[60] Provisional application No. 60/001,389 Jul. 24, 1995.

[21] Appl. No.: 650,203

[22] Filed: May 10, 1996

[51] Int. Cl.[6] ..... B61L 23/00; B61L 29/24

[52] U.S. Cl. ..... 246/473.3; 362/32

[58] Field of Search ..... 246/473.3; 362/32, 362/296

[56] References Cited

U.S. PATENT DOCUMENTS

| | | | |
|---|---|---|---|
| 3,576,563 | 4/1971 | Scott | 246/473.3 |
| 4,283,716 | 8/1981 | Pasquali | 246/473.3 |
| 4,636,036 | 1/1987 | Pasquali | 246/473.3 |
| 5,438,485 | 8/1995 | Li et al. | 362/32 |

OTHER PUBLICATIONS

Electronics Engineers' Handbook 3rd Ed. 1989, Donald G. Fink, Donald Christiansen, Editors, McGraw Hill, Inc.—ISBN-0-07-020982-0, pp. 22-30 to 22-34.

Railway Signal Equipment Catalog by Union Switch & Signal Division of American Standard, Inc., Swissvale, Pa, Chapter 10A4, Rev. 8/80, pp. 1, 4, 5.

*Primary Examiner*—S. Joseph Morano

*Attorney, Agent, or Firm*—Kevin A. Sembrat

[57] ABSTRACT

An apparatus for providing a light signal to a signal unit at an overhead location along a railway signal structure, particularly a cantilever signal structure having a vertical mast and an arm assembly extending therefrom. Signal units may be located along the mast and/or the arm assembly. A light source is provided at or near ground level so as to be readily accessible by a maintainer and is connected by fiber optic cable to the signal units. Thus, light produced by the light source travels through the optical fiber to the signal units.

15 Claims, 4 Drawing Sheets

RAILROAD SIGNAL WITH REMOTE LIGHT SOURCE

CROSS-REFERENCE TO RELATED APPLICATION

This application claims the benefit of U.S. Provisional Application No. 60/001,389, filed Jul. 24, 1995, which is hereby incorporated by reference in its entirety.

BACKGROUND OF THE INVENTION

1. Field of the Invention

This invention relates generally to signals used in railway systems, and more particularly to methods and apparatus for illuminating such signal units.

2. Description of the Related Art

Cantilever crossing signals, such as can be seen in prior art FIG. 1, are currently used in the railroad industry for providing overhead signalling in order to warn motorists of an oncoming train. The cantilever signal structure extends over the road and provides maximum visibility to the motorists. These cantilever signal structures typically have a single upright mast and an elongated arm assembly supported at and extending outward from an upper end of the mast. It is industry practice to secure the cantilever arm assembly to the mast through the use of clamps welded to the arm assembly.

Signal units are then provided along the arm assemblies and sometimes along the mast itself. Signal units contain a light source, typically incandescent lamps, to produce the light signal. External circuitry enables flashes of light to be produced by the lamps. A reflector is then provided adjacent to respective lamps of the signal. Electrical wiring is run along the cantilever signal structure to connect the lamps to a power source located at some distance from the cantilever signal structure.

The mast is typically provided with a ladder so that a signal maintainer may vertically ascend the mast to access the arm assembly. A walkway is provided along the full length of the cantilever arm assembly. The arm assembly walkway allows a maintainer to traverse the length of the arm assembly to service and maintain the signal units attached to the arm assembly, such as to replace the lamps of the signal units. The ladder and walkway are used instead of a separate platform, truck or train so that the signals may be serviced and maintained without impeding traffic.

It is standard industry practice to run electrical wiring up through the signal masts and out along the horizontal structure to the particular signal units along the assembly. If a signal unit malfunctions or if a signal unit lamp requires replacement, a maintainer must climb the mast ladder and traverse the arm assembly walkway to that signal unit. Traversing the ladder and walkway add additional time to the replacement process. Furthermore, as the length of electrical wiring increases, the likelihood that a short somewhere along that electrical wiring also increases.

In some respects, the use of an overhead mast ladder and an arm assembly walkway may be undesirable. For example, there are always risks associated with a maintainer scaling an elevated structure especially in adverse weather conditions. A chain may typically be provided at the end of the walkway and handrails are provided on either side of the walkway to prevent a maintainer from falling from the arm assembly walkway. Furthermore, the maintainer may have to attach a safety belt to reduce the risk associated with the height of the walkway. In order to prevent unauthorized individuals from ascending the cantilever signal, anticlimb guards have been designed in the railroad signalling industry which may be affixed to the mast ladder. Unfortunately, such anticlimb guards could potentially circumvented. Furthermore, rain and snow may accumulate on the arm assembly walkway, which could cause the increased hazard of ice during adverse weather conditions.

Thus, it would be advantageous to develop an overhead signal structure that did not require a maintainer to scale a ladder and traverse an overhead walkway for routine maintenance.

SUMMARY OF THE INVENTION

The present invention allows for locating the light source of an overhead railway signal structure remotely from the overhead-mounted signal units and at a location readily accessible by a maintainer. The invention is particularly well suited for use with cantilever signal structures having a vertical mast and an arm assembly extending from an upper end thereof. The invention may also be used with signal structures having two spaced vertical masts and having an arm assembly connected to the vertical masts at an upper end of the masts.

The invention involves providing a light source at or near ground level and connecting to fiber optic cable the light source. The fiber optic cable then connects to reflectors located in the signal units. Thus, light produced at the ground level light source travels through the optical fiber to the reflectors in the signal units. This system eliminates the need for a maintainer conducting maintenance on the signal light unit from having to scale the mast ladder and traversing the arm assembly walkway. Lamps may be replaced at ground level and lamp units may be repaired at ground level. This provides for a quicker replacement and servicing of the signals. Thus, risks associated with the height of the signal units are reduced.

Furthermore, the risk associated with an electrical short is reduced as electrical wiring need only be run as far as the light source unit. No electrical wiring need be run from the light source up the mast and over the arm assembly to the respective signal units. Other objects and advantages of the invention will become apparent from a description of certain present preferred embodiments thereof shown in the drawings.

DETAILED DESCRIPTION OF THE PREFERRED EMBODIMENTS

Figure 1:
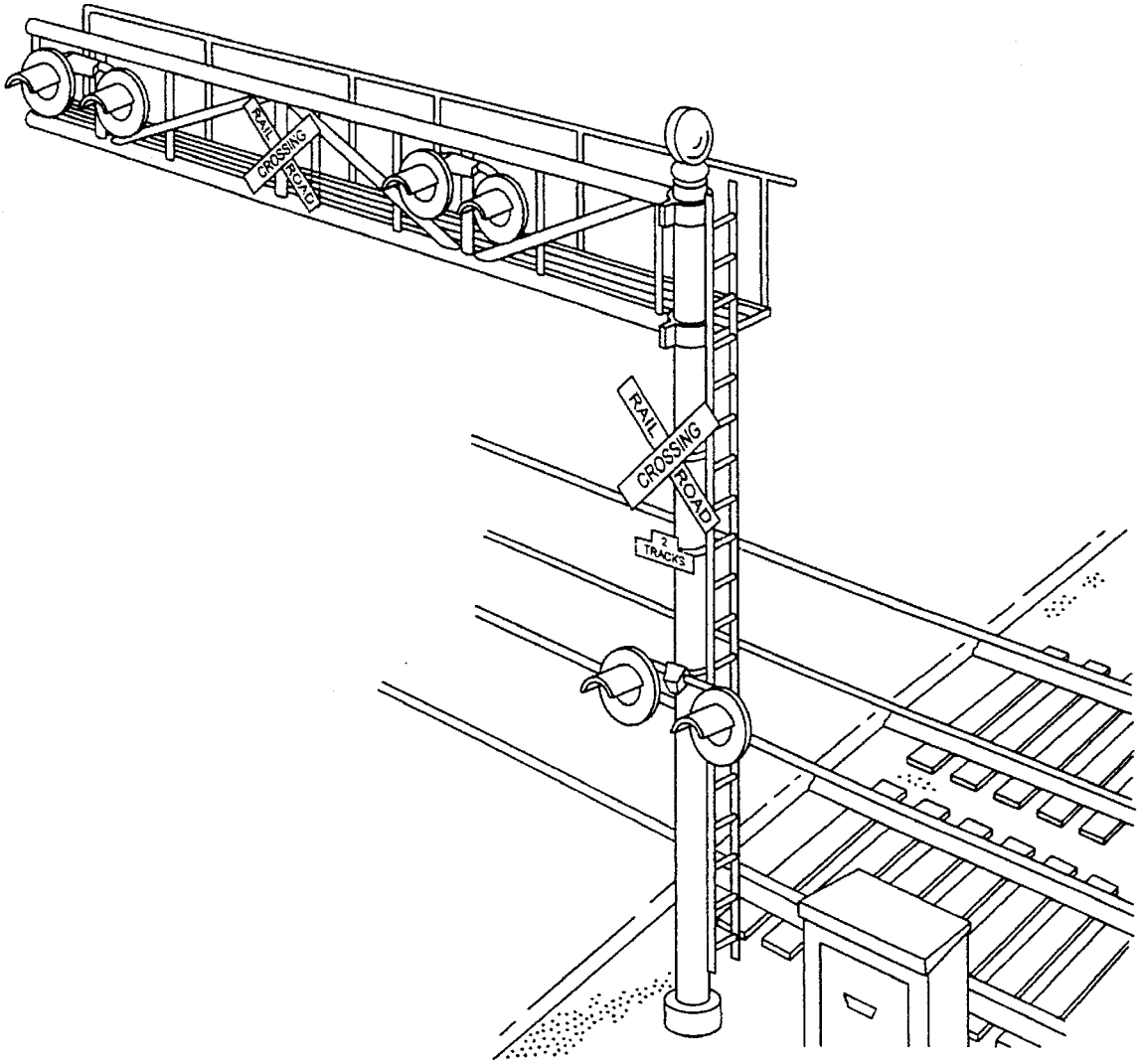
(PRIOR ART) Fig. 1
FIG. 1 is a perspective view of a prior art cantilever signal structure.
Figure 2:
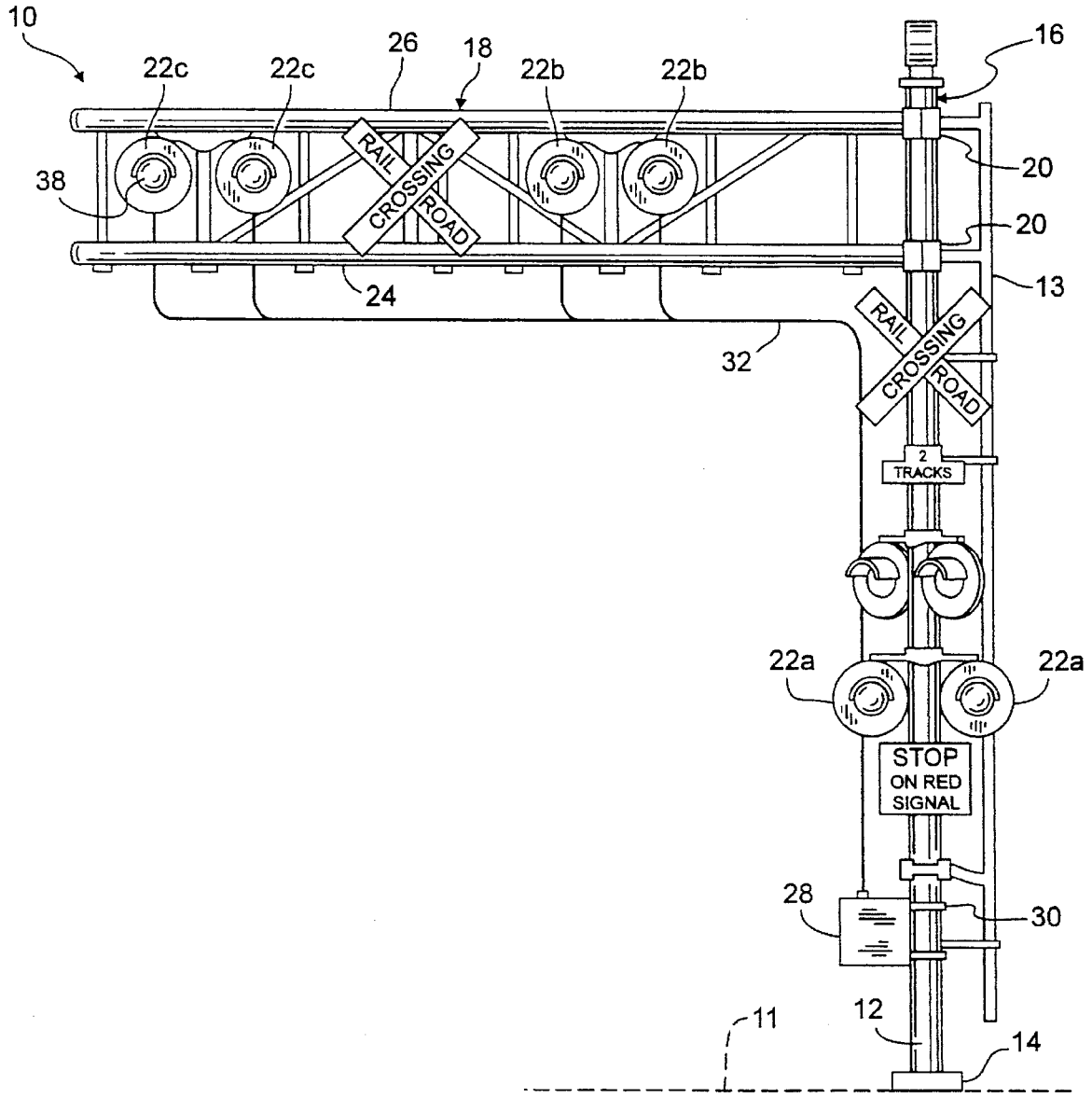
FIG. 2 is an elevational view of the preferred cantilever signal having a remote light source.

Referring to FIG. 2, the present preferred cantilever signal structure 10 having a remote light source is shown. The cantilever signal structure 10 is comprised of an elongated, vertical mast 12 having a first end 14 which is anchored to the ground 11. The mast 12 extends upward from the ground 11 so as to have a second end 16 which is distal to the ground 11. Thus, the mast 12 extends substantially perpendicular to the ground 11. A ladder 13 is provided substantially along the height of the mast 12. Attached to the second end 16 of the mast 12 is an arm assembly 18, such that the arm assembly 18 extends outward from mast 12. The arm assembly 18, therefore, extends substantially perpendicular to and spaced above the ground 11. The arm assembly 18 may be mounted to the mast 12 by any preferred means as are standard in the industry, but is preferably mounted by metal clamps 20. Providing a supporting structure for the arm assembly 18 is a bottomrail 24 and a headrail 26.

Figure 3:
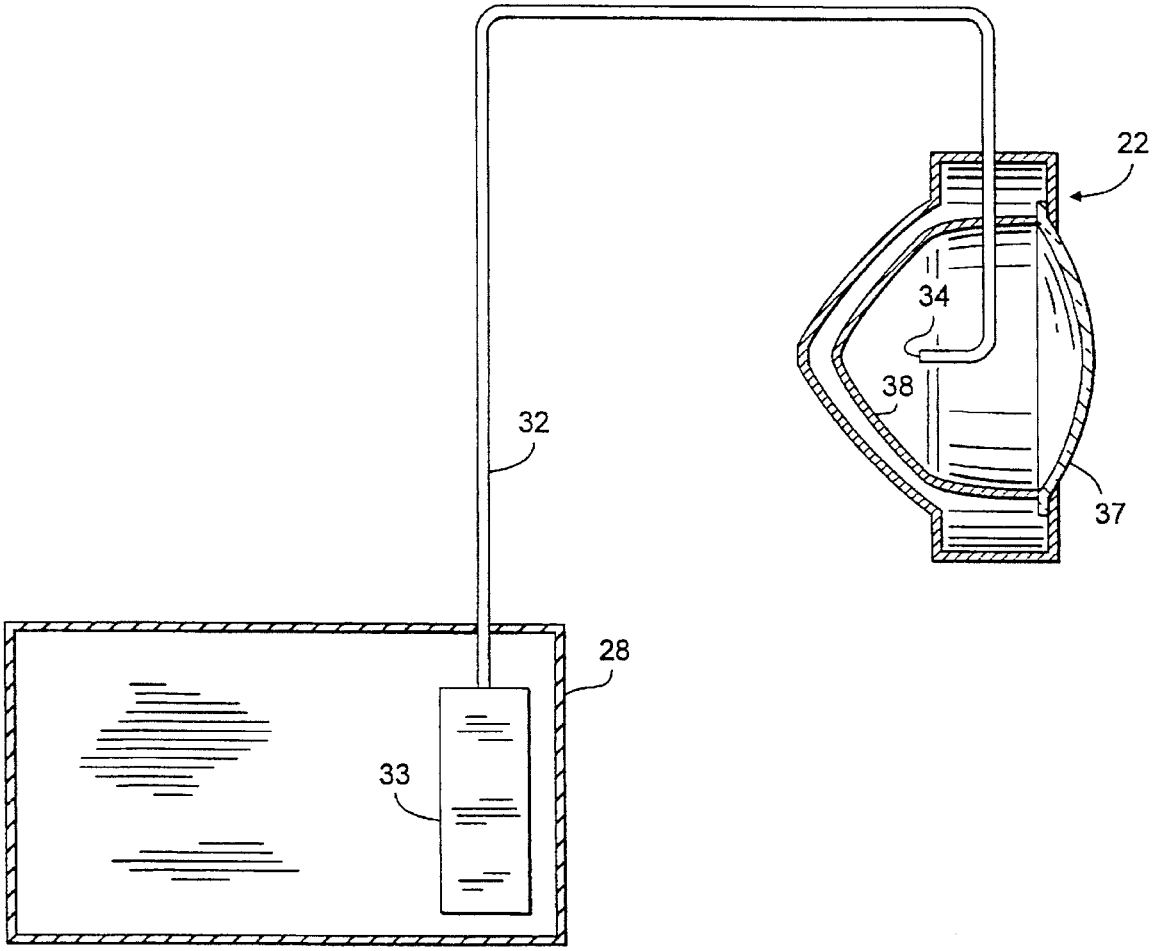
FIG. 3 is a schematic view of a portion of the preferred cantilever signal.

A number of signal units 22 are preferably provided along the cantilever signal structure 10. One or more signal units, such as signal unit 22*a*, may be provided along the mast 12. Other signal units, such as signal units 22*b* and 22*c* may be provided along the arm assembly 18. The signal units 22 of the present invention, shown partially cut away in FIG. 3, are comprised of a reflector 38 in proximity to an end 34 of fiber optic cable 32. A suitably colored diffusing roundel 37 is mounted in front of a reflector 38. The fiber optic cable end 34 and the reflector 38 are mounted such that the light emanating from the fiber optic cable end 34, which will diffuse naturally at an approximate angle of 30°, will be intercepted by reflector 38, which is so configured as to most efficiently reflect the light as diffused from the fiber optic cable end 34. Reflector 38, preferably being of the parabolic type, will reflect the light in a parallel beam through colored roundel 37. Additional constructional details of signal unit 22 are well known to those skilled in the art of signalling, and will not be described here.

A light source housing 28 is then positioned at a location accessible to a maintainer (not shown) standing at or near ground level. Preferably, the light source housing 28 is mounted directly to the vertical mast 12. The light source housing 28 may be mounted to the mast 12 by any preferred means such as by a clamp 30. It is further preferred that the light source housing 28 be mounted to the vertical mast 12 at a location of approximately four to five feet above ground level. Mounting the light source housing 28 upon the vertical mast 12 at this height maintains the accessibility of the light source housing 28 but removes it sufficiently from ground level so as to eliminate the risk of damage or shorting due to ground level water or vehicular damage.

Referring next to FIG. 3, the light source housing 28 contains any number of light sources 33. It is preferred to use one light source for each signal unit. The light source 33 may be of any suitable type, such as a prefocused tungsten—filament incandescent lamp; a prefocused lamp is constructed with an integral condensing lens as part of the lamp envelope. These lamps are manufactured by such companies as Sylvania, General Electric, GTE, Osram and Phillips; in the lamp industry, they are identified by the type designation "EZX". Fiber optic cable 32 connects at one end to the light source housing 28. Within housing 28, an exposed, polished end of fiber optic cable 32 is mounted by suitable means at the focal point of the integral condensing lens of the prefocused incandescent lamp that comprises light source 33.

Fiber optic cable 32 is known in the optical industry as a "fiber optic light guide"; it consists of a non-coherent bundle of optical fibers. The outside diameter of this bundle is from one-eighth to one-fourth of an inch; the bundle is covered with a wrapping of stainless steel wire and a PVC plastic sheath to protect it from physical damage and moisture. As cantilever-mounted signals can extend as far as forty feet over a highway, it is necessary to use a cable with a low loss rate. Cables are available with loss rates as low as 0.0031 per foot when transmitting light in the wavelengths emitted by a tungsten illuminant. Such cables are available from suppliers such as Dolan-Jenner, Fostec, and Cuda.

The fiber optic cable 32 then connects at an opposite end to the respective signal units 22*a*, 22*b*, 22*c* (see FIG. 2). It is preferred that respective fiber optic cables 32 connect the light source 33 to each signal unit 22*a*–22*c*. Either one or a number of fiber optic cables may travel between each light source 33 and each signal unit 22.

The fiber optic cable 32 may travel to the respective signal units 22*a*–22*c* by any preferred means. One such means is to run the fiber optic cable 32 along the exterior of mast 12 and along the exterior of the arm assembly 18. The fiber optic cable 32 may be affixed, for example, to the bottomrail 24 or the headrail 26 of the arm assembly 18. Alternatively, the fiber optic cable 32 may be routed through the hollow interior portions of the vertical mast 12 and/or the arm assembly 18.

In operation, the light source 33 within the light source housing 28 is activated. Light generated from the light source 33 is directed within the fiber optic cable 32, which acts as a light guide, thereby delivering the light to reflectors 38 located in the signal units 22*a*–22*c*. Light originating from the light source 33 of the light source housing 28 travels through the fiber optic cable 32 to reflectors 38 of the signal units 22*a*–22*c*. Light is then emanated from the reflectors 38 of the respective signal units 22*a*–22*c*. No replacement of the lamps is necessary at the signal units 22. Thus, replacement of the lamps or any other routine maintenance necessary at the light source housing 28 may be done without ascending the mast 12 or traversing the arm assembly 18.

The light source 33 of the light source housing 28 is preferably designed to produce pulses or flashes of light. Thus, when it is desired to convey a warning to highway traffic, a flashing signal at the respective signal units 22*a*–22*c* may be produced as is currently the railroad industry practice. The flashes of light produced at the light source housing 28 will travel through the fiber optic cable 32 and travel to the respective reflectors 38 of the signal units 22*a*–22*c*. The flashing light signal will then emanate from the reflector 38 of any signal unit 22 to which the light source housing 28 is connected.

Figure 4:
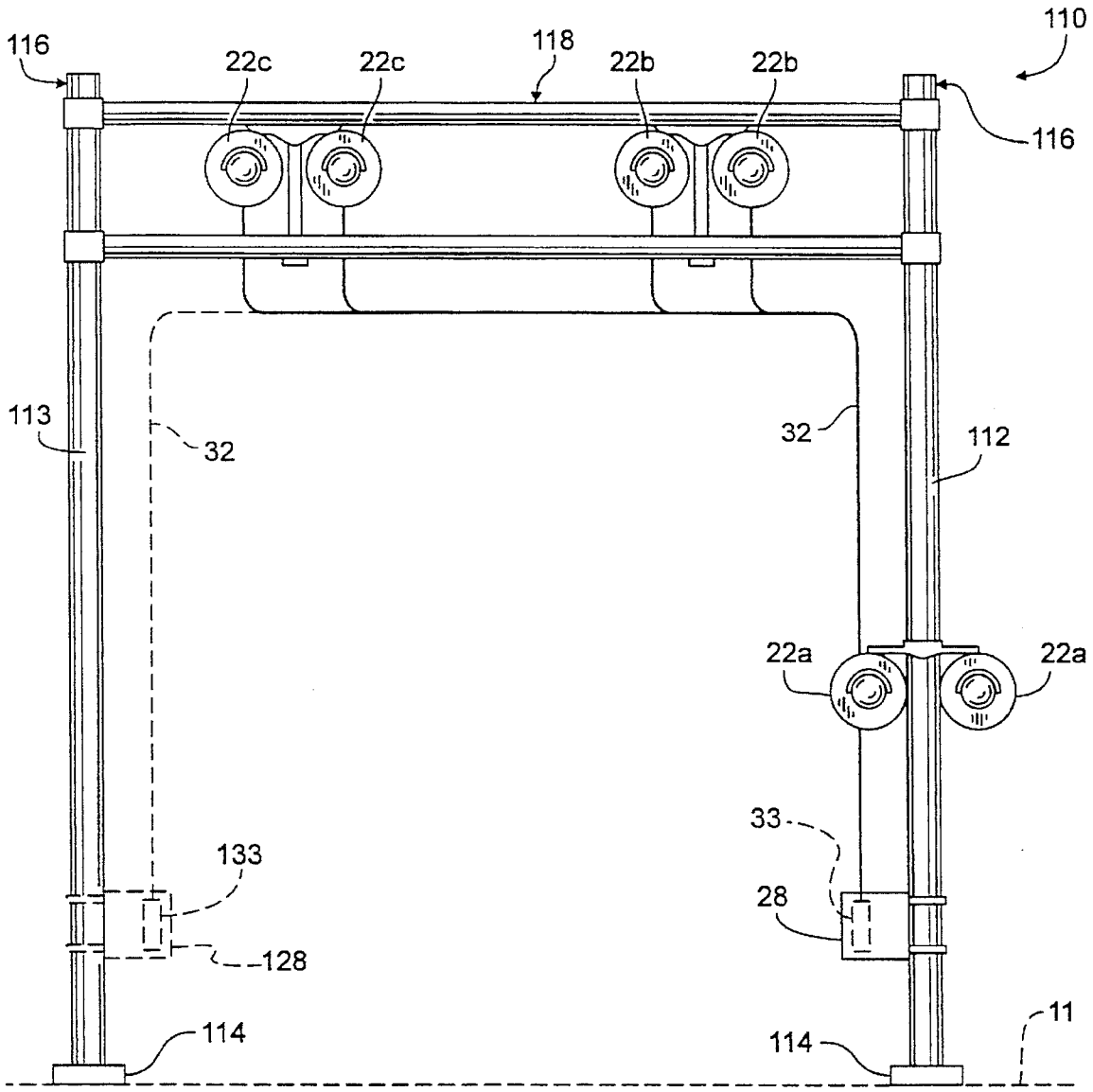
FIG. 4 is an elevational view of an alternate cantilever signal having a remote light source

Although the description of the preferred remote light source has to this point been made with reference to a cantilever signal structure having a single vertical mast having an arm assembly extending from an upper end thereof, it is understood that other signal structures may employ the present remote light source. For example, with reference to FIG. 4, an alternative signal structure 110 is shown. The alternative signal structure 110 utilizes two elongated vertical masts 112, 113. Each vertical mast has a first end 114 that is anchored to the ground 11 and has a second end 116 which is distal to the ground 11. Attached to the respective second ends 116 of the masts and connecting the masts is an arm assembly 118. The vertical masts 112, 113 extend substantially perpendicular to the ground 11. Further, the arm assembly 118 extends substantially perpendicular to and spaced above the ground 11. As with the first preferred embodiment, signal units 22*a*, 22*b*, 22*c* may be provided along the vertical masts 112, 113 and/or along the arm assembly 118. In all other respects, the remote light source system of the light signal structure of FIG. 4 operates substantially identical to the remote light source system shown with reference to FIGS. 2 and 3. Thus, a light source 33 is provided at or near ground level, within light source housing 28. Fiber optic cable 32 then connects the light source 33 to the respective signal units 22*a*, 22*b*, 22*c*. As an alternative, a second light source 133 (shown in dotted line in FIG. 4) within second light source housing 128 may be used together with light source 33. Second light source 133 is structurally identical to light source 33 and operated in an identical fashion, some or all of the signal units may be connected to either or both of the light sources 33, 133 through fiber optic cable 32.

While certain present preferred embodiments have been shown and described, it is distinctly understood that the invention is not limited thereto but may be otherwise embodied within the scope of the following claims.

What is claimed is:

1. A combination of an apparatus for providing a light signal along a railway track and a signal structure having an arm assembly that is provided substantially parallel to ground and is at a distance from the ground, the combination comprising:

a light source affixed to the signal structure at a first position;

an elongated fiber optic cable connected at a first end to said light source; and at least one railway signal unit affixed to the signal structure at a second position which is different from said first position, wherein said at least one signal unit is connected to said fiber optic cable at a second end of said cable, such that light generated at said light source travels through said fiber optic cable and is emanated from said at least one signal unit.

2. The combination of claim 1, wherein said signal structure has an elongated vertical mast in which one end of said mast is affixed to the ground, and said arm assembly extends outwardly substantially perpendicular to said mast at an opposite end of said mast.

3. The combination of claim 2, wherein said at least one signal unit is provided along said mast.

4. The combination of claim 2, wherein said at least one signal unit is provided along said arm assembly.

5. The combination of claim 2, wherein said light source is provided along said mast proximate to the ground.

6. The combination of claim 2, wherein said light source is a prefocused tungsten filament incandescent lamp.

7. The combination of claim 1, wherein said light source is provided along the ground.

8. The combination of claim 1, wherein said signal structure having two spaced elongated vertical masts, in which one end of each said mast is affixed to the ground and wherein said arm assembly is connected to opposite ends of said masts.

9. The combination of claim 1, wherein said light source is a prefocused tungsten filament incandescent lamp.

10. An apparatus for emitting a light signal from a railway signal structure, in combination with the railway signal structure, the combination comprising:

light source means for emitting the light signal;

a signal unit affixed to the railway signal structure, wherein said signal unit is remote from said light source means;

light guide means for receiving and guiding the light signal, wherein said light guide means includes a first end and a second end; and a light source housing affixed to the railway signal structure and protectively housing said light source means and said first end of said light guide means wherein said first end is positioned proximate to said light source means within said housing, thereby to receive and guide the light signal within said light guide means to said second end, and wherein said second end is positioned within said signal unit, thereby to emanate said light signal therefrom said signal unit.

11. The combination of claim 10, wherein said light source means utilizes a tungsten filament.

12. The combination of claim 10, wherein said light source means is a prefocused tungsten filament incandescent lamp.

13. The combination of claim 10, wherein said light guide means is a fiber optic light guide cable.

14. The combination of claim 13, wherein said fiber optic light guide cable is affixed to the railway signal structure in at least one position.

15. A combination of an apparatus for providing a light signal along a railway track and a signal structure having an arm assembly that is provided substantially parallel to ground and is at a distance from the ground, the combination comprising:

a light source;

an elongated fiber optic cable connected at a first end to said light source at least one railway signal unit, wherein said at least one signal unit is connected to said fiber optic cable at a second end of said cable, such that light generated at said light source travels through said fiber optic cable and is emanated from said at least one signal unit;

wherein the signal structure has an elongated vertical mast in which one end of said mast is affixed to the ground, and said arm assembly extends outwardly substantially perpendicular to said mast at an opposite end of said mast; and wherein said elongated fiber optic cable is affixed along said elongated vertical mast and along said arm assembly.

* * * * *